US007552718B2

(12) United States Patent
Engel et al.

(10) Patent No.: US 7,552,718 B2
(45) Date of Patent: Jun. 30, 2009

(54) ELECTRICAL DRIVE ARRANGEMENT FOR A FUEL INJECTION SYSTEM

(75) Inventors: Joseph A. Engel, Obercorn (LU); Germano D. Nascimento, St-Claude-de-Diray (FR); Laurence Chirez, Chambon/Cisse (FR); Francois Herbin, Cosnes et Romain (FR); Edwin H. Marx, Landscheid (DE); Marvin G. Hau, Carmel, IN (US); James J. Blagrave, Noblesville, IN (US)

(73) Assignee: Delphi Technologies, Inc., Troy, MI (US)

( * ) Notice: Subject to any disclaimer, the term of this patent is extended or adjusted under 35 U.S.C. 154(b) by 194 days.

(21) Appl. No.: 11/811,888

(22) Filed: Jun. 12, 2007

(65) Prior Publication Data

US 2008/0308070 A1 Dec. 18, 2008

(51) Int. Cl.
*F02M 51/00* (2006.01)

(52) U.S. Cl. ..... 123/490

(58) Field of Classification Search ..... 123/490, 123/494, 488, 499
See application file for complete search history.

(56) References Cited

U.S. PATENT DOCUMENTS 5,681,193 A * 10/1997 Pham et al. ..... 440/1
5,947,078 A * 9/1999 Fujiwara ..... 123/491

FOREIGN PATENT DOCUMENTS

DE 198 10 379 A1 * 3/1999

* cited by examiner

*Primary Examiner*—Hieu T Vo
(74) *Attorney, Agent, or Firm*—Thomas N. Twomey

(57) ABSTRACT

An electrical drive arrangement of a fuel injection system comprising a power supply operatively connected to an injector driver stage which, in turn, is operatively connected to at least one fuel injector. The electrical drive arrangement includes a voltage regulation device operatively connected between the power supply and the injector driver stage, wherein the voltage regulation device is arranged to regulate the voltage supply from the power supply to the injector driver stage.

20 Claims, 6 Drawing Sheets

ELECTRICAL DRIVE ARRANGEMENT FOR A FUEL INJECTION SYSTEM

TECHNICAL FIELD

The present invention relates to an automotive fuel injection system and, more particularly, to an electrical drive arrangement for use in such a fuel injection system.

BACKGROUND ART

Modern automotive vehicle engines are generally equipped with fuel injectors for injecting fuel (e.g. gasoline or diesel fuel) into the individual cylinders of the engine. The fuel injectors are coupled to a source of high pressure fuel that is delivered to the injectors by way of a fuel delivery system. The fuel injectors typically employ a valve needle that is actuated to disengage and re-engage an associated valve seat so as to control the amount of high pressure fuel that is metered from the fuel delivery system and injected into a corresponding engine cylinder. It is known to use solenoid operated injectors in which an electrically driven solenoid is operably connected to the valve needle. Energising the solenoid causes the valve needle to disengage from its seat, thus permitting fuel delivery, and de-energising the solenoid causes the valve needle to re-engage it seat, thus preventing fuel delivery.

It is also known to use piezoelectrically operated fuel injectors that act either directly on the valve needle, or indirectly on the valve needle by way of a servo valve arrangement, to cause movement of the valve needle.

The injectors of the engine are controlled by an electrical drive arrangement. FIG. 1 shows a simplified schematic of a known drive arrangement 2 which includes an injector driver stage 4 that is supplied with power from a vehicle power supply 6, typically the vehicle battery, and provides power and control inputs to one or more fuel injectors 8 (two of which are shown in FIG. 1).

The injector driver stage 4 is a circuit arrangement that is configured to select a specific one of the injectors 8 for operation and to apply an operating voltage thereto. The functionality of the injector driver stage 4 is controlled by an Engine Control Unit 10 (ECU) of the vehicle within which it is installed.

A known problem is that such electrical drive arrangements do not operate under ideal conditions and are typically supplied with electrical power that is subject to spurious electrical oscillations, hereinafter referred to as 'noise'. A significant proportion of power supply noise can be compensated for by the injector drive stage 4 under the control of the ECU 10 since some sources of noise are predictable. However, some sources of noise are not predictable and such noise affects detrimentally the level of control that the ECU 10 has over the operational timing of the injectors 8.

DISCLOSURE OF THE INVENTION

It is against this background that the invention provides an electrical drive arrangement of a fuel injection system comprising a power supply operatively connected to an injector driver stage which, in turn, is operatively connected to at least one fuel injector, and a voltage regulation device operatively connected between the power supply and the injector driver stage. The voltage regulation device is arranged to regulate the voltage input from the power supply.

The invention provides an elegant solution to the problem of an electrical power supply that is inherently noisy which would otherwise affect detrimentally the performance of the fuel injectors.

Preferably the voltage regulation device may include a field effect transistor connected between the power supply and the injector driver stage in a source follower configuration. More specifically, the voltage regulation device may comprise an input terminal connected to the power supply and an output terminal connected to the injector driver stage wherein the field effect transistor may be interposed between the input terminal and the output terminal.

The field effect transistor may be a metal oxide semiconductor field effect transistor, preferably of the N-channel type, and accordingly may include a drain terminal connected to the input terminal of the voltage regulation device, a source terminal connected to the output terminal of the voltage regulation device, and a gate terminal.

In order to provide a filtered electrical supply from the power supply to the gate terminal, the electrical drive arrangement may include a filter device operatively connected between the gate terminal of the field effect transistor and the input terminal of the voltage regulation device. This configuration ensures that the gate terminal of the field effect transistor is supplied with a relatively smooth voltage which has a corresponding effect on the conductivity of the field effect transistor from the source terminal to the drain terminal.

In one embodiment, the filter device may take the form of a RC low pass filter circuit and may include a resistor element connected between the gate terminal and the input terminal of the voltage regulation device and a capacitor connected between the gate terminal and an electrical ground connection.

Although such a circuit could be configured to have an operating point that is specific to the application in which the electrical drive arrangement is to be used, in one embodiment the resistor element and the capacitor element are selected so as to provide the filter device with a time constant of approximately 1 millisecond.

In another embodiment, the value of the resistor element and/or the capacitor element are time-dependently variable thereby providing a means to modify the frequency response of the filter device. The frequency response of the voltage regulation device can therefore be tuned in order to optimise its operation for the type of devices e.g. fuel injectors with which it is used.

A permanent load, optionally in the form of a further resistor element, may be connected between the source terminal and the electrical ground connection in order to optimise the operating point of the field effect transistor. The ohmic value of the permanent load may be selected as a function of the on-state resistance of the field effect transistor.

In another embodiment, a current sense element is connected between the capacitor element and the electrical ground connection, and a feedback path is connected therebetween to provide a injector voltage signal to the gate terminal of the filter device. This configuration provides the benefit that the voltage at the gate terminal of the field effect transistor is modified as a function of the load on the injector driver stage which adjusts the conductivity of the transistor thereby improving the load response of the voltage regulation device.

In a further embodiment, the voltage regulation device includes a differential amplifier configured to amplify the voltage difference between the output voltage of the filter device and the voltage at the source terminal of the field effect transistor and supply an amplified output voltage to the gate terminal of the field effect transistor. The differential amplifier has the effect of increasing the voltage input at the gate terminal in response to an increased load applied by the injector drive stage.

In another aspect of the invention, there is provided an electrical drive arrangement of a fuel injection system comprising a power supply operatively connected to an injector driver stage which, in turn, is operatively connected to at least one fuel injector, a voltage regulation device operatively connected between the power supply and the injector driver stage and having a gate terminal and an input terminal and a filter device operatively connected between the gate terminal of the voltage regulation device and the input terminal thereby supplying a filtered voltage from the power supply as an input to the gate terminal. The filter device includes a resistor element connected between the gate terminal and the input terminal and a capacitor element connected between the gate terminal and an electrical ground connection.

In another aspect of the invention, there is provided an electrical drive arrangement of a fuel injection system comprising a power supply operatively connected to an injector driver stage which, in turn, is operatively connected to at least one fuel injector and a voltage regulation device operatively connected between the power supply and the injector driver stage and arranged to regulate the voltage supplied from the power supply to the injector driver stage. The electrical drive arrangement further includes a differential amplifier arranged to increase the voltage input to the voltage regulation device in response to an increased load applied to the injector driver stage.

It should be noted that preferred and/or optional features of the first aspect of the invention may be combined with the second and third aspects of the invention.

BRIEF DESCRIPTION OF THE DRAWINGS

Reference has already been made to FIG. 1 which shows a known electrical drive arrangement for a fuel injection system. In order that the invention may be more readily understood, reference will now be made, by way of example only, to the accompanying drawings in which.

DETAILED DESCRIPTION

Figure 1:
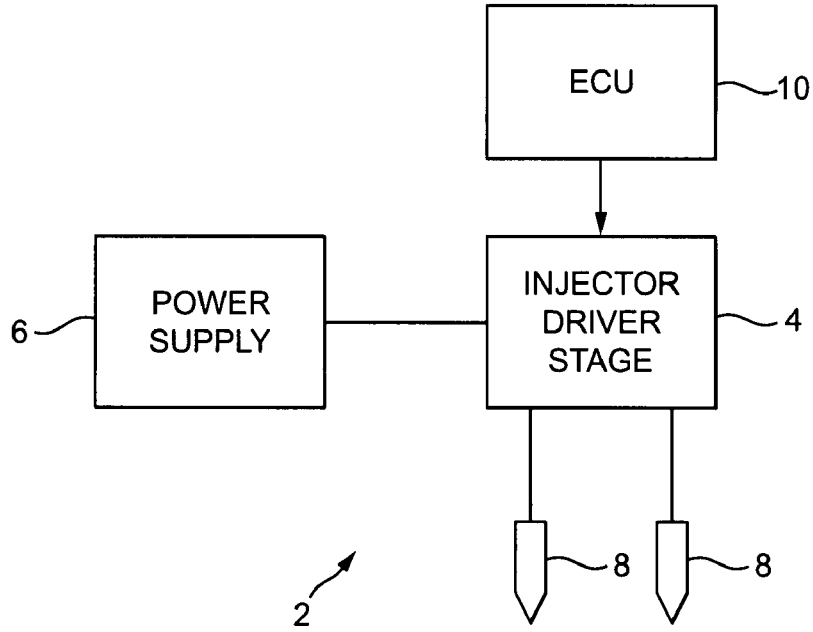
Figure 2:
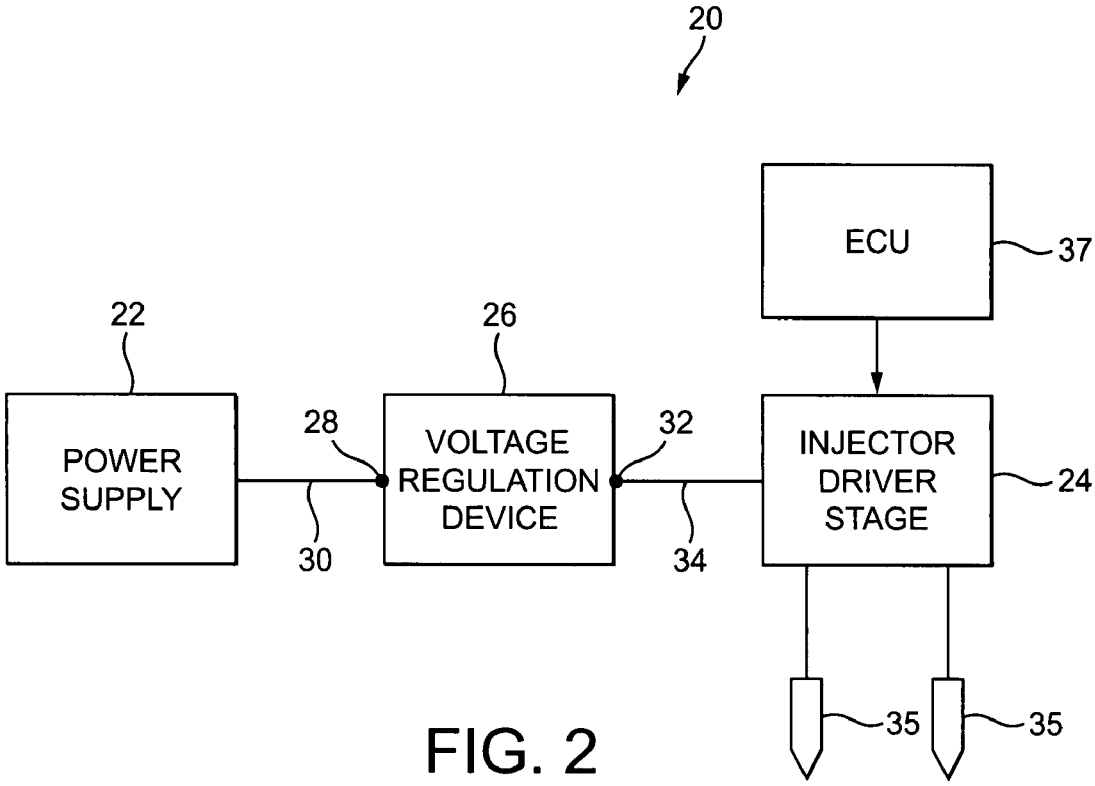
FIG. 2 is an electrical drive arrangement in accordance with an embodiment of the invention.

FIG. 2 shows an electrical drive arrangement 20 of a fuel injection system in which a power supply 22 is connected to an injector driver stage 24 via a voltage regulation device 26. The power supply 22 is connected to an input terminal 28 of the voltage regulation device 26 via a first voltage supply line 30 and an output terminal 32 of the voltage regulation device 26 is connected to the injector driver stage 24 via a second voltage supply line 34. Although not shown in FIG. 2, the power supply 22 is the battery of the vehicle in which the electrical drive arrangement 20 is installed. Typically, the power supply 22 supplies a nominal voltage of 12 or 24 Volts DC to the voltage regulation device 26 and, thus, to the injector driver stage 24.

Due to local electrical and electromagnetic influences, for example electrical components such as lighting and audio systems, emitters of electromagnetic interference such as vehicular-based telecommunication systems and the like, the DC voltage output from the power supply 22 is not ideal but includes high frequency components superimposed thereon. The voltage regulation device 26 of the invention provides a means to stabilize the voltage that is input to the injector driver stage 24 against the effects of the unstable DC supply voltage.

The injector driver stage 24 is connected to a plurality of injectors 35 (only two of which are shown in FIG. 2 for simplicity) and provides a means to select and electrically drive a specific injector under the control of an engine control unit 37 (ECU) in order to deliver a predetermined quantity of fuel. It should be appreciated that the configuration of the injector driver stage 24 is not the focus of the invention and so will not be described in further detail here.

Figure 3:
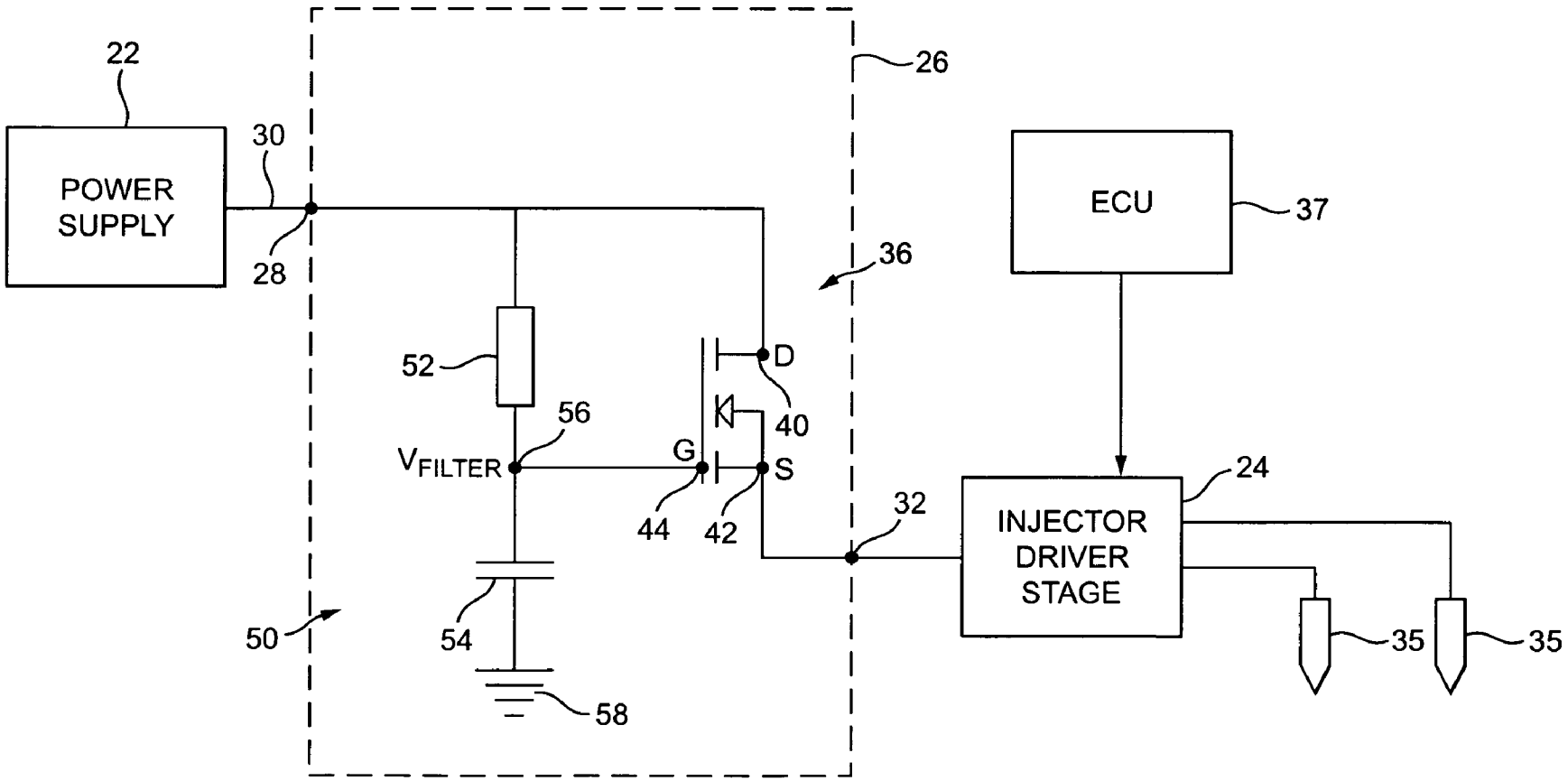
FIG. 3 is a detailed view of the electrical drive arrangement in FIG. 2.

Referring to FIG. 3, the voltage regulation device 26 comprises an N-channel metal oxide semiconductor field-effect transistor 36 (hereinafter 'MOSFET') which includes a drain terminal 40, a source terminal 42 and a gate terminal 44. The drain terminal 40 of the MOSFET 36 is connected to the input terminal 28 of the voltage regulation device 26 and the source terminal 42 of the MOSFET 36 is connected to the output terminal 32 of the voltage regulation device 26.

The gate terminal 44 of the MOSFET 36 is connected to the input terminal 28 of the voltage regulation device 26 through a low pass filter 50 comprising a resistor element 52 and a capacitor element 54 that are connected to each other at a node 56. The gate terminal 44 of the MOSFET 36 is connected to the node 56 and is, therefore, connected to the input terminal 28 through the resistor element 52 and is connected to a ground connection 58 through the capacitor element 54. The low pass filter 50 generates a filtered output voltage $V_{filter}$ at the node 56 which forms an input voltage signal to the gate terminal 44 of the MOSFET 36.

The values of the resistor element 52 and the capacitor element 54 are configured to the electrical dynamics of the injector such that the low pass filter 50 operates to block those frequencies present on the voltage supply line 30 that the ECU 37 cannot compensate and pass those frequencies which the ECU 37 can compensate.

In the preferred embodiment of the invention, particularly advantageous values of the resistor element 52 and capacitor element 54 are selected so as to provide the low pass filter 50 with a time constant of approximately 1 millisecond (ms), which corresponds to a filter cut-off frequency of approximately 160 Hz. Furthermore, the value of the capacitor element 54 is selected to be significantly greater than the parasitic capacitance of the MOSFET 36, preferably, between ten and one hundred times greater than the parasitic capacitance.

As is shown in FIG. 3, the MOSFET 36 is arranged in a 'source follower', or 'common drain', configuration such that voltage between the gate terminal 44 and the source terminal 42, which is derived from the low pass filter 50, determines the conductivity of the MOSFET 36 from the drain terminal 40 to the source terminal 42.

Since the gate terminal 44 is shielded from the high frequency noise present on the power supply line 30 by the low pass filter 50, the conductivity of the MOSFET 36 from the drain terminal 40 to the source terminal 42 is substantially constant compared to the 'raw' power supply voltage on supply line 30. As a result, the voltage present at the source terminal 42 of the MOSFET 36, and therefore the voltage present at the output terminal 32 of the voltage regulation device 26, are substantially free from noise.

Figure 3A:
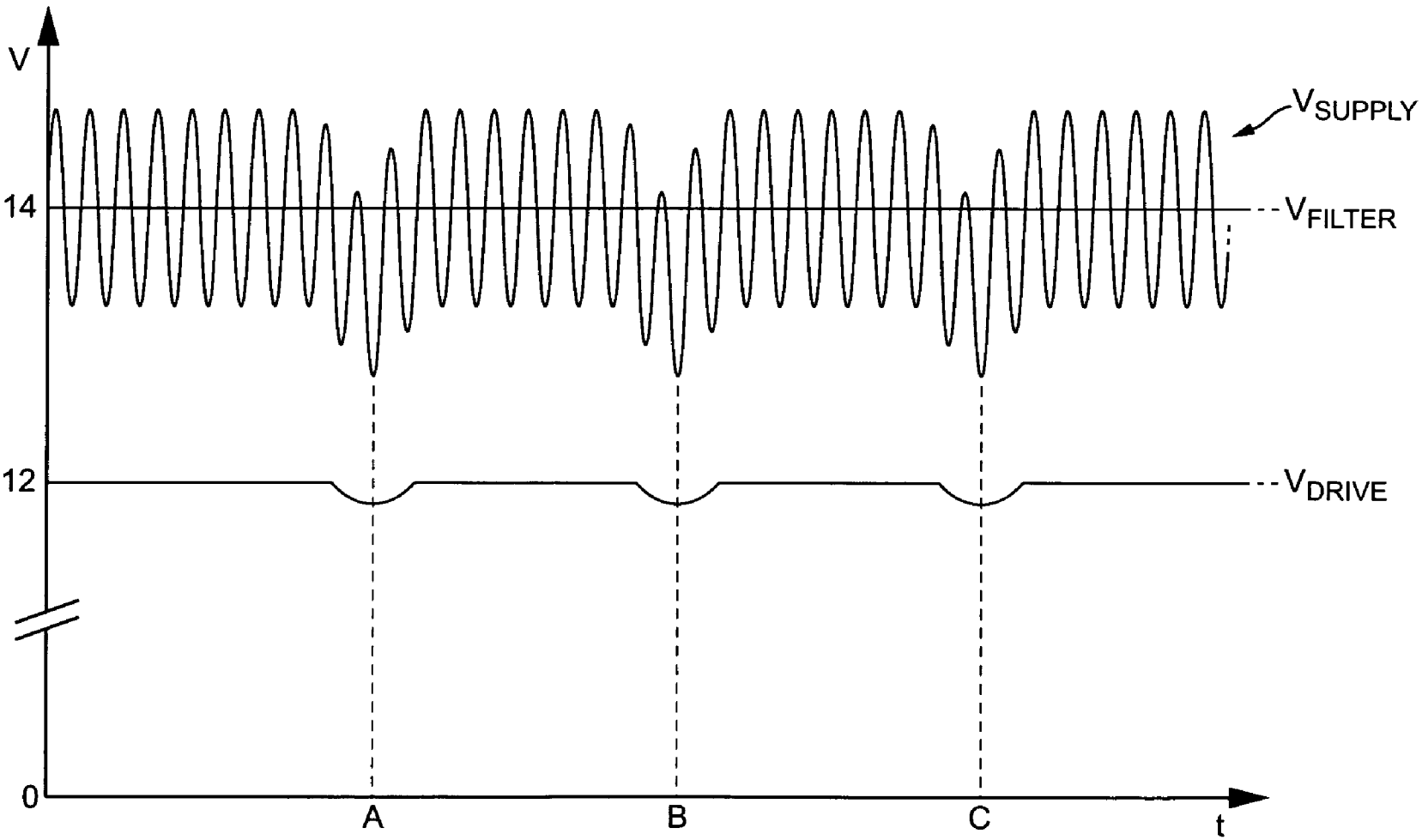
FIG. 3*a* is a graph showing voltage values of $V_{supply}$, $V_{filter}$, and $V_{drive}$ associated with the electrical drive arrangement shown in FIG. 3.

The beneficial effect of the voltage regulation device 26 is clearly represented in FIG. 3*a*. The voltage from the power supply 22 ($V_{supply}$) is shown oscillating about a mean voltage level (substantially equal to $V_{filter}$), which voltage is filtered by the low pass filter 50 to provide the filtered voltage ($V_{filter}$) at the gate terminal 44 of the MOSFET 36. The oscillating input voltage is shown to droop briefly at points A, B and C that are indicative of instances at which an electrical load is applied to the power supply, for example due to activation of an injector. However, the filtered supply voltage ($V_{filter}$) is substantially unaffected by the voltage drops and thus supplies a substantially constant voltage source to the gate terminal 44.

The voltage $V_{drive}$ at the output terminal 32 of the voltage regulation device 26 substantially follows the filtered voltage $V_{filter}$, although it is subject to a slight voltage droop at the instances that an electrical load is applied, at points A, B and C. Furthermore, it should be noted that the voltage present at the output terminal 32 ($V_{drive}$) has a reduced value when compared to the mean voltage value of the voltage supply ($V_{supply}$) by an amount substantially equal to the initiation voltage of the MOSFET 36. Since this reduction in voltage is a known value, and is predictable, the ECU 37 is configured to compensate for the voltage reduction.

By virtue of the above circuit configuration, a smoother injector drive voltage is obtained which enables the injector driver stage 24 to be substantially isolated from the noisy supply voltage. Moreover, the configuration of the voltage regulation device 26 is elegantly simple thus providing a cost effective and reliable solution which does not significantly increase the overall complexity and cost of the electrical drive arrangement 20.

Figure 4:
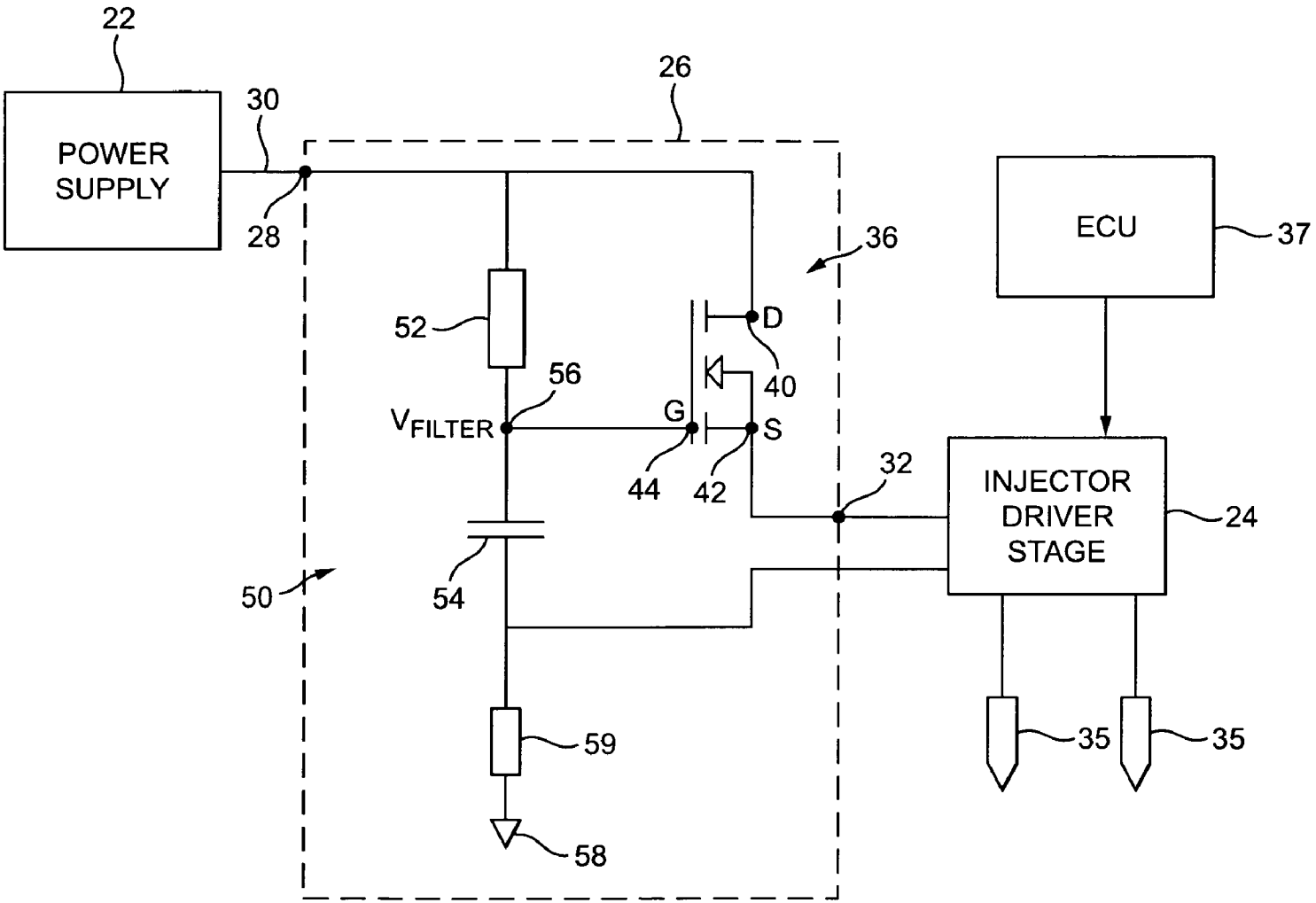
FIG. 4 is detailed view of an electrical drive arrangement in accordance with an alternative embodiment of the invention.

FIG. 4 shows an another embodiment of the invention which reduces the sensitivity of the output voltage of the voltage regulation device 26 to varying loads, particularly those that draw a high current from the power supply 22, for example in circumstances in which it is necessary to operate more than one injector simultaneously. The embodiment of FIG. 4 is similar to the embodiment of FIG. 3 so only the differences are described in detail here and, where appropriate, like components are denoted by like reference numerals.

In FIG. 4, the capacitor element 54 of the low pass filter 50 is not connected directly to the ground connection 58 as it is in the embodiment of FIG. 3. Instead, the capacitor element 54 is connected to a current sensing element 59 which, in turn, is connected to the ground connection 58. The high side of the current sensing element 59 is also connected to a feedback path 57 from the injector driver stage 24.

The feedback path 57 provides a voltage value of a low voltage side of the injectors 35 to the high side of the current sensing element 59. The current sensing element 59 therefore senses the current that flows through the injector driver stage 24 to the ground connection 58. Since the feedback path 57 is connected between the capacitor element 54 and the current sensing element 59, the voltage across the capacitor element 54 is modified by the voltage across the current sensing element 59 as a function of the current flowing through it. As a result, the voltage at the gate terminal 44 of the MOSFET 36 is modified as a function of the load on the injector driver stage 24 such that the conductivity of the MOSFET 36 is adjusted accordingly. This improves the load response of the voltage regulation device 26.

Figure 4A:
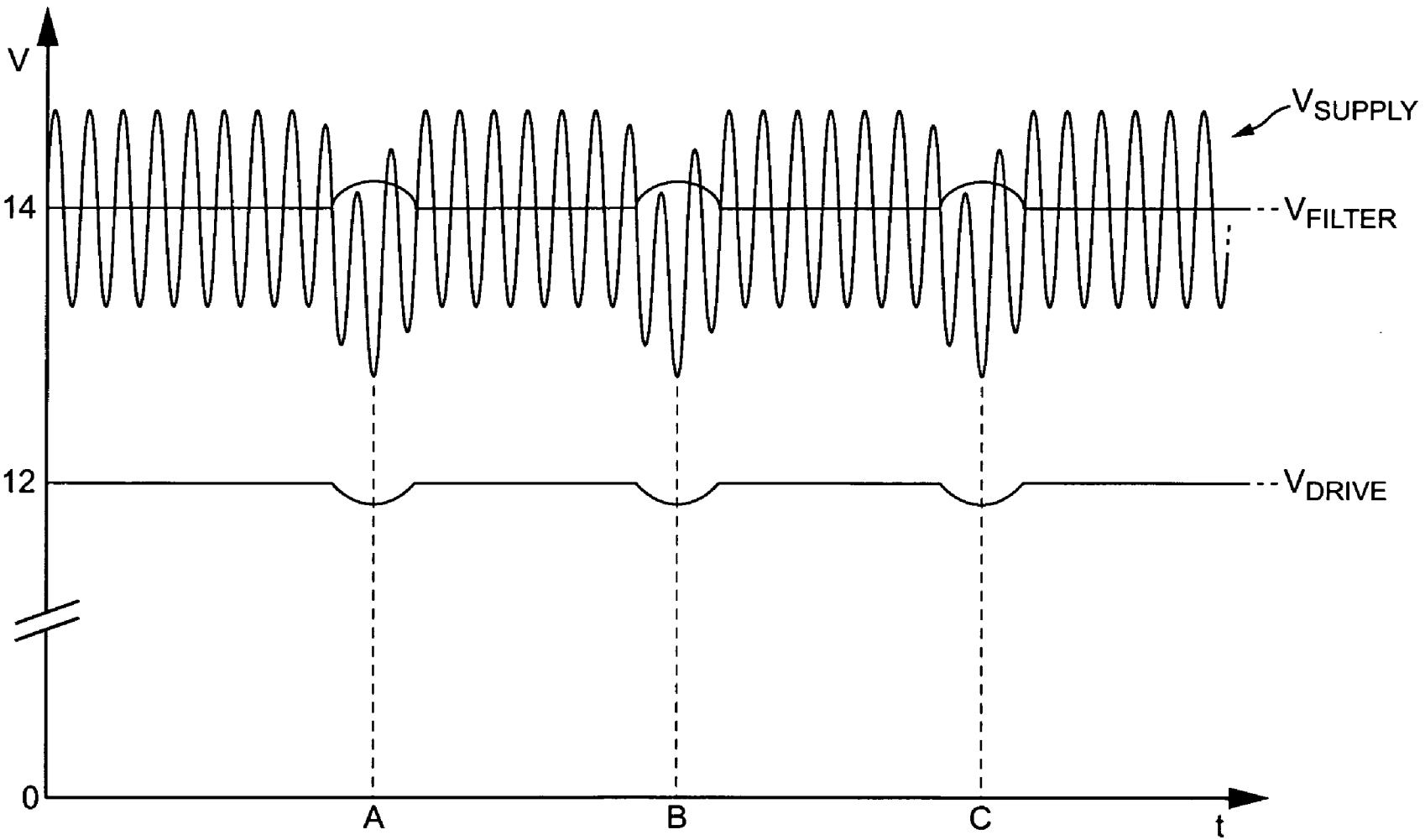
FIG. 4*a* is a graph showing voltage values of $V_{supply}$, $V_{filter}$, and $V_{drive}$ associated with the electrical drive arrangement shown in FIG. 4.

FIG. 4*a* shows the values of $V_{supply}$, $V_{filter}$ and $V_{drive}$ for the circuit of FIG. 4. When compared with FIG. 3*a*, it can be seen that the value of the filtered voltage $V_{filter}$ is increased when the load is applied to the output of the voltage regulation device at points A, B and C. If the voltage at the gate terminal 44 of the MOSFET 36 increases in circumstances when the load is applied, the output voltage $V_{drive}$ of the voltage regulation device 26 has greater resilience to applied loads which is particularly advantageous during circumstances in which two injectors are operated simultaneously.

Although the embodiment in FIG. 4 provides an elegant configuration that improves the resilience of the voltage regulation device 26 to applied loads, in an alternative embodiment (not shown) the facility is provided to increase the value of $V_{filter}$ by providing a variable resistor element and/or a variable capacitor element in place of the respective elements 52 and 54, whilst omitting the current sensing device 59. In such an arrangement, the ECU 37 controls the value of the capacitor and/or resistor elements thus providing active control of the frequency response of the low pass filter 50. As a result, the output at the source terminal 42 can be increased during times of high power demand.

Figure 5:
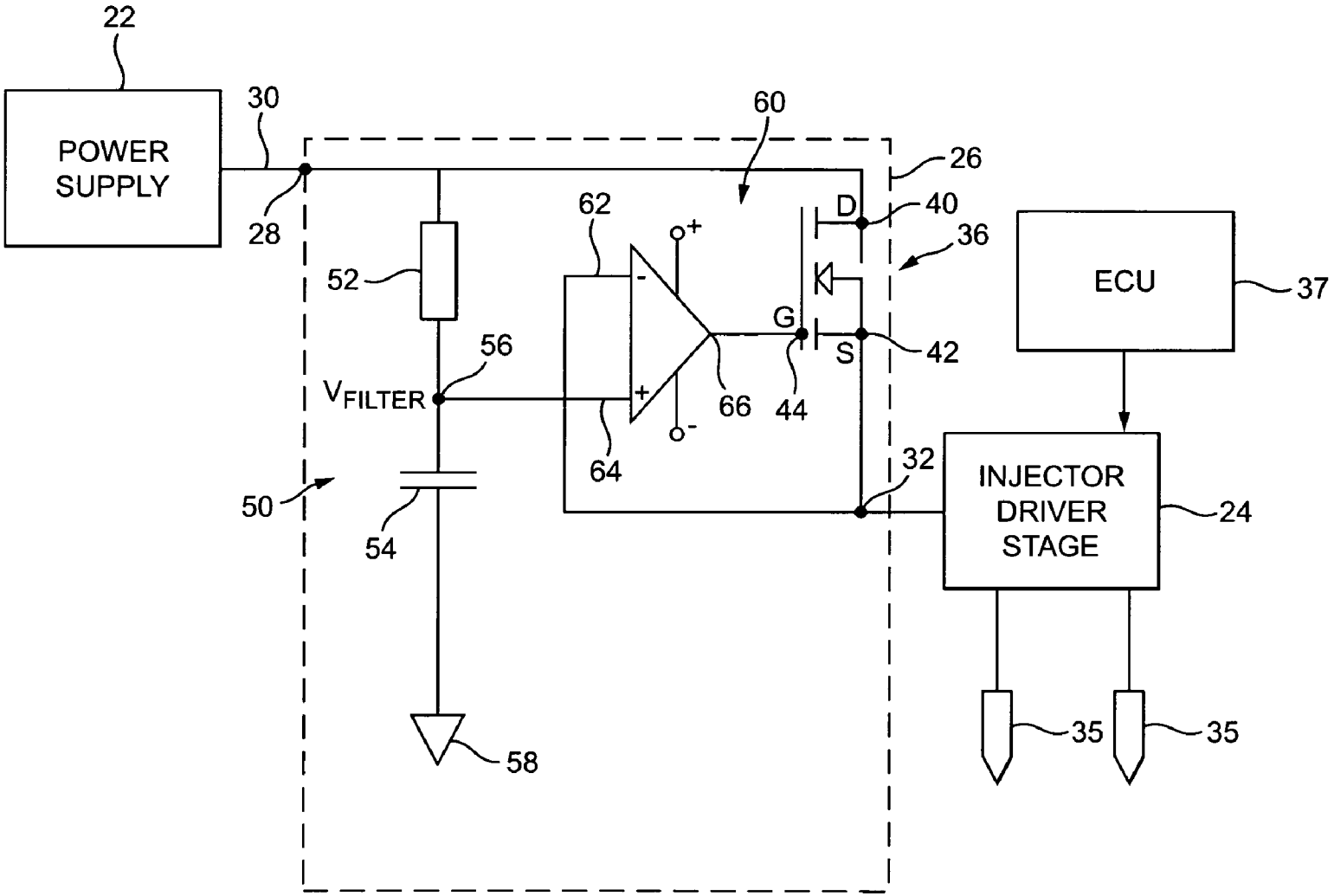
FIG. 5 is a detailed view of an electrical drive arrangement in accordance with a further alternative embodiment of the invention.

A further alternative embodiment is shown in FIG. 5. This embodiment is similar to those already described so only the differences are described in detail. Where appropriate like components are denoted with like reference numerals.

In FIG. 5, the voltage regulation device 26 includes a differential amplifier 60 interposed between the low pass filter 50 and the MOSFET 36. As is customary, the differential amplifier includes an inverting input 62, a non-inverting input 64 and an output 66 (hereinafter 'amplifier output').

The node 56 of the low pass filter 50 is connected to the non-inverting input 64 of the differential amplifier 60 and the amplifier output 66 is connected to the gate terminal 44 of the MOSFET 36. Thus, the non-inverting input 64 receives the filtered voltage $V_{filter}$ of the power supply 22, which voltage therefore constitutes the set point of the differential amplifier 60.

The inverting input 62 of the differential amplifier 60 is connected to the source terminal 42 of the MOSFET 36 such that the output of the MOSFET 36 is provided to the differential amplifier 60 as a feedback loop. Therefore, the differential amplifier 60 amplifies the difference between the inverting input 62 and the non-inverting input 64 and supplies the amplified difference to the gate terminal 44 of the MOSFET 36.

As a result of the configuration of FIG. 5, the differential amplifier 60 increases the voltage input at the gate terminal 44 in response to an increased load applied by the injector driver stage 24. Therefore, the output terminal 32 of the MOSFET 36 is shielded from high frequency noise from the power supply 22 and exhibits improved robustness to high load conditions. The effect of this is to substantially eliminate the voltage droop at the output terminal 32 of the voltage regulation device 24 under a wide range of loads applied by the injector driver stage 24.

It should be appreciated that various modifications may be made to the above described embodiments without departing from the scope of the inventive concept as defined by the appended claims.

For example, in a further embodiment the operating point of the MOSFET 36 is optimised by including a load element, in the form of a resistor element connected to ground, at the source terminal 42 of the MOSFET 36. The value of the resistor is selected as a function of the on-state resistance of the MOSFET 36.

The invention claimed is:

1. An electrical drive arrangement of a fuel injection system comprising a power supply operatively connected to an injector driver stage which, in turn, is operatively connected to at least one fuel injector, and a voltage regulation device operatively connected between the power supply and the injector driver stage, wherein the voltage regulation device is arranged to regulate the voltage supplied from the power supply to the injector driver stage.

2. The electrical drive arrangement of claim 1, wherein the voltage regulation device includes a field effect transistor connected between the power supply and the injector driver stage in a source follower configuration.

3. The electrical drive arrangement of claim 2, wherein the voltage regulation device further includes an input terminal connected to the power supply and an output terminal connected to the injector driver stage and wherein the field effect transistor is interposed between the input terminal and the output terminal.

4. The electrical drive arrangement of claim 3, wherein the field effect transistor includes a drain terminal connected to the input terminal of the voltage regulation device, a source terminal connected to the output terminal of the voltage regulation device, and a gate terminal.

5. The electrical drive arrangement of claim 4, wherein a filter device is operatively connected between the gate terminal of the field effect transistor and the input terminal of the voltage regulation device, thereby supplying a filtered voltage ($V_{filter}$) from the power supply as an input to the gate terminal.

6. The electrical drive arrangement of claim 5, wherein the filter device includes:

i) a resistor element connected between the gate terminal and the input terminal; and ii) a capacitor element connected between the gate terminal and an electrical ground connection.

7. The electrical drive arrangement of claim 6, wherein the value of the resistor element and/or the capacitor element are variable thereby providing a means to modify the frequency response of the filter device.

8. The electrical drive arrangement of claim 6, including a load element connected between the source terminal and the electrical ground connection, the ohmic value of the load element being selected as a function of the on-state resistance of the field effect transistor.

9. The electrical drive arrangement of claim 6, wherein a current sense element is connected between the capacitor element and the electrical ground connection, and wherein a feedback path is connected therebetween to provide a injector voltage signal to the gate terminal of the voltage regulation device.

10. The electrical drive arrangement of claim 6, wherein the voltage regulation device includes a differential amplifier configured to amplify the voltage difference between the output voltage of the filter device and the voltage at the source terminal of the field effect transistor and supply an amplified output voltage to the gate terminal of the field effect transistor.

11. The electrical drive arrangement of claim 2, wherein the field effect transistor is a metal oxide semiconductor field effect transistor or an N-channel metal oxide semiconductor field effect transistor.

12. An electrical drive arrangement of a fuel injection system comprising:

a power supply operatively connected to an injector driver stage which, in turn, is operatively connected to at least one fuel injector, a voltage regulation device operatively connected between the power supply and the injector driver stage and having a gate terminal and an input terminal, a filter device operatively connected between the gate terminal of the voltage regulation device and the input terminal, thereby supplying a filtered voltage ($V_{filter}$) from the power supply as an input to the gate terminal, wherein the filter device includes a resistor element connected between the gate terminal and the input terminal and a capacitor element connected between the gate terminal and an electrical ground connection.

13. The electrical drive arrangement of claim 12, wherein the value of the resistor element and/or the capacitor element are variable thereby providing a means to modify the frequency response of the filter device.

14. The electrical drive arrangement of claim 12, wherein a current sense element is connected between the capacitor element and the electrical ground connection, and wherein a feedback path is connected therebetween to provide a injector voltage signal to the gate terminal.

15. The electrical drive arrangement of claim 14, wherein the voltage regulation device includes a differential amplifier configured to amplify the voltage difference between the output voltage of the filter device and the voltage at a source terminal of the voltage regulation device and supply an amplified output voltage to the gate terminal.

16. An electrical drive arrangement of a fuel injection system comprising:

a power supply operatively connected to an injector driver stage which, in turn, is operatively connected to at least one fuel injector, a voltage regulation device operatively connected between the power supply and the injector driver stage and being arranged to regulate the voltage supplied from the power supply to the injector driver stage, and a differential amplifier arranged to increase the voltage input to the voltage regulation device in response to an increased load applied to the injector driver stage.

17. The electrical drive arrangement of claim 16, wherein the voltage regulation device comprises an input terminal connected to the power supply, an output terminal connected to the injector driver stage and a field effect transistor disposed therebetween including a drain terminal connected to the input terminal, a source terminal connected to the output terminal, and a gate terminal.

18. The electrical drive arrangement of claim 17, wherein a filter device is operatively connected between the gate terminal of the field effect transistor and the input terminal of the voltage regulation device, thereby supplying a filtered voltage ($V_{filter}$) from the power supply as an input to the gate terminal.

19. The electrical drive arrangement of claim 18, wherein the filter device includes: i) a resistor element connected between the gate terminal and the input terminal; and ii) a capacitor element connected between the gate terminal and an electrical ground connection.

20. The electrical drive arrangement of claim 19, wherein the value of the resistor element and/or the capacitor element are variable thereby providing a means to modify the frequency response of the filter device.

* * * * *